United States Patent [19]

Wade

[11] Patent Number: 4,489,809

[45] Date of Patent: Dec. 25, 1984

[54] RAILROAD TRACK DEFLECTION ACTIVATED GREASE PUMP

[76] Inventor: John A. Wade, 13611 W. 95th St., Lenexa, Kans. 66215

[21] Appl. No.: 455,290

[22] Filed: Jan. 3, 1983

[51] Int. Cl.[3] ..... B61K 3/00

[52] U.S. Cl. ..... 184/3.1; 184/6.28; 184/27 R; 184/32

[58] Field of Search ..... 184/3.1, 3.2, 6.28, 184/26, 27 R, 32, 102; 104/279; 417/460, 464, 465

[56] References Cited

U.S. PATENT DOCUMENTS

| | | | |
|---|---|---|---|
| 1,557,936 | 10/1925 | Jouanneaux | 417/464 |
| 1,789,100 | 1/1931 | Gust et al. | 184/3.1 |
| 1,892,240 | 12/1932 | Knapp | 184/27 R |
| 1,930,400 | 10/1933 | Stilwell | 184/3.1 |
| 1,941,265 | 12/1933 | Mennie | 184/3.1 |
| 2,029,828 | 2/1936 | Mennie | 184/3.1 |
| 2,152,696 | 4/1939 | Huck | 184/3.1 |
| 2,220,716 | 11/1940 | Hetsch | 184/27 R |
| 2,229,111 | 1/1941 | Mennie | 184/3.1 |
| 2,230,657 | 2/1941 | Stern | 184/3.1 |
| 2,231,394 | 2/1941 | Reece | 184/3.1 |
| 2,237,312 | 4/1941 | Overmier et al. | 184/3.1 |
| 2,285,082 | 6/1942 | Bolt | 184/3.1 |
| 2,355,241 | 8/1944 | Rodman et al. | 184/3.1 |
| 2,554,002 | 5/1951 | Beamesderfer et al. | 184/27 R |
| 3,059,586 | 10/1962 | Brailsford | 417/465 |
| 3,254,607 | 6/1966 | Norton | 417/460 |

FOREIGN PATENT DOCUMENTS

| | | | |
|---|---|---|---|
| 460133 | 10/1949 | Canada | 184/3.1 |

*Primary Examiner*—David H. Brown
*Assistant Examiner*—John E. Griffiths, Jr.
*Attorney, Agent, or Firm*—Glenn K. Robbins

[57] ABSTRACT

A grease pump for railroad tracks operable by vertical deflections of the rail caused by the weight of the train as the train wheels pass over the track. The pump comprises a housing anchored to the ground and connected to a grease source. Pump operating means comprise a rigid beam connected to the track rail at one end and to a pump operating rod at an opposite end. The operating rod is connected to a cap-like pressure member fitting over the housing and operable by the rail deflection movement to draw grease through inlet port means from the grease source and pump the grease through outlet port means to a track lubricator. Check valves are provided in the pump to control the grease flow.

25 Claims, 10 Drawing Figures

20
22
24
26
28
32
34
36
37
38
40
42
44
46
4
5
6
74
78
80
82
84
86
88
90
92
94
98
100
102
110
112
114
118

RAILROAD TRACK DEFLECTION ACTIVATED GREASE PUMP

BACKGROUND OF THE INVENTION

In the past there has existed a need for lubricating railroad tracks where the curves in such tracks are subjected to great wear caused by the centrifugal force of the weight of the train bearing against the restraining portion of the rail. The outside rail in such curves and tangent portions is subjected to considerable force as is the mating flange portions of the outside wheels of the locomotive and railroad cars. Such wear over a period of time causes damage to both the wheels and the railroad track necessitating expensive repairs, replacement and costly downtime.

Various types of lubricators have been provided to lubricate the inside of the rail track in such severe wear producing track curves. Such lubrication reduces the wear between the wheel and the rail and prolong their life. Some such lubricators are dispensed by an operator, others may be timed and still others may be operated by the rail displacement caused by the weight of the train passing over the track.

Such lubricators while effective to one degree or another, have in general been complex in structure and have required various moving parts subject to disrepair and requiring significant maintenance and expensive installations.

SUMMARY OF THE INVENTION

By means of this invention there has been provided a grease pump for lubricating the rail of a railroad track that is activated when the immense force created by the passage of the wheels of the train over the rail causes the rail to deflect. Such deflections which are readily visible vary somewhat depending on the condition of the roadbed, the weight of the train and other physical factors but generally are in the range of several tenths of an inch up to one-half an inch and even larger and represent a massive energy source that is employed to lubricate automatically the rail and minimize wear in the outside rail in curves and the like where centrifugal force creates a wear problem.

In this invention the force of the deflecting rail is caused to move a rigid horizontal beam fixed at one end to the rail and at an opposite end to an operating rod connected to a grease pump. The up and down vertical reciprocatory movement causes a pressure member connected to the operating rod to charge grease from a grease source such as a hopper or the like through the grease pump housing and expel grease from the pump to a suitable rail lubricating device.

The grease pump housing may be in the form of a cylinder having an inlet port from the grease source opening into a grease reservoir area at one end which communicates with an outlet port leading to the outside of the pump and to the rail lubricating device. Suitable check valves are provided in the inlet and outlet ports to control the flow of grease in the system.

The pressure member has a cap-like form fitting over the end of the grease pump and has a skirt portion extending over the sides of the grease pump adjacent the ends. Seals provided by a series of O-rings seal the pump at the side while permitting a slight rocking movement of the pressure member as the rail deflects up and down. The slight back and forth rocking movement causes grease to be withdrawn from the grease source to the pump and be expelled therefrom to the rail lubricating device which may be of conventional form.

The pressure member is provided with tensioning means to regulate and bias the pressure member against the end of the pump housing. Also, adjustment means are provided to accommodate any shift in the rail and ensure proper alignment between the pump which is anchored to the ground and the beam of the operating means.

Such adjustment is effected by provided mating flanges which connect the beam and the operating rod with adjustment holes to provide for vertical and horizontal shift. Any axial shift is accommodated by providing a sliding fit between the operating rod fixed to the pressure member and a sleeve-like bushing flanged to the beam. The beam is provided with a slot-like opening receiving the end of the operating rod. Movement of the rod within the opening is accommodated whether it be by adjustment of the biasing force or any axial shift of the rail.

The pumping action is automatically effected in the pump as the rail is deflected in the repetitive cycles as the train wheels pass over the portion of the rail connected to the beam of the pump operating means. The massive force is transmitted through the operating means to the pressure member and the pump and no other moving parts are required in the pump system. This simplification of the moving part system greatly reduces maintenance and wear. The pump and operating device provided are rugged in construction and provide an improved lubricating system which has the reliability and minimum of maintenance required for a practical rail lubricator of an automatic nature.

The above features are object of this invention. Further objects will appear in the detailed description which follows and will be further apparent to those skilled in the art.

For the purpose of illustration of this invention preferred embodiments thereof are shown in the accompanying drawing. It is to be understood that the drawing is for purpose of description only that the invention is not limited thereto.

IN THE DRAWING

DESCRIPTION OF THE INVENTION

Figures 1, 2, 8:
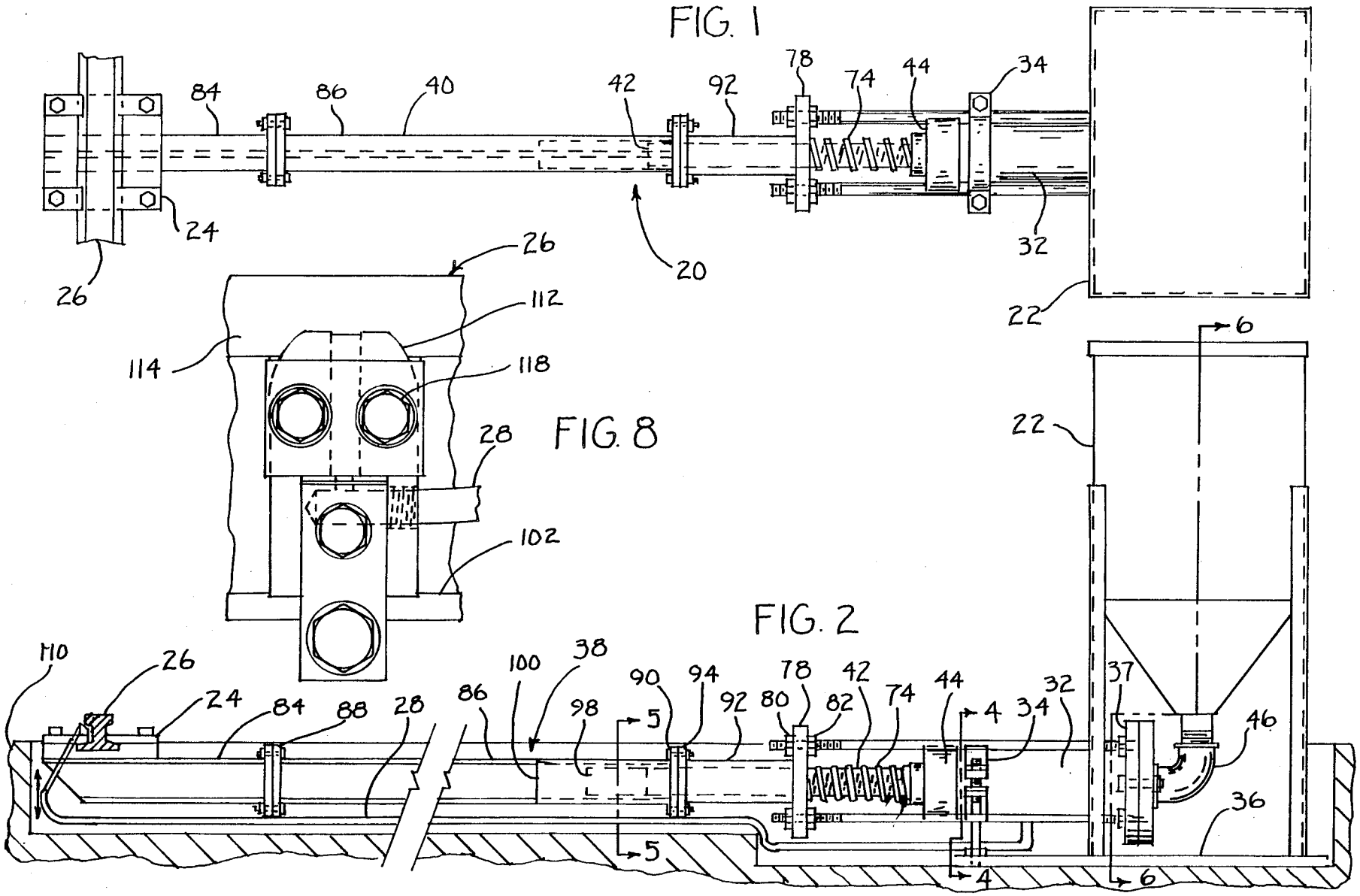
FIG. 1 is a top plan view of the grease pump shown connected to a railroad track.
FIG. 2 is a view in vertical section taken through the rail and showing the pump in elevation from the left side of FIG. 1.
FIG. 8 is a view in elevation taken from the left side of FIG. 7.
Figure 3:
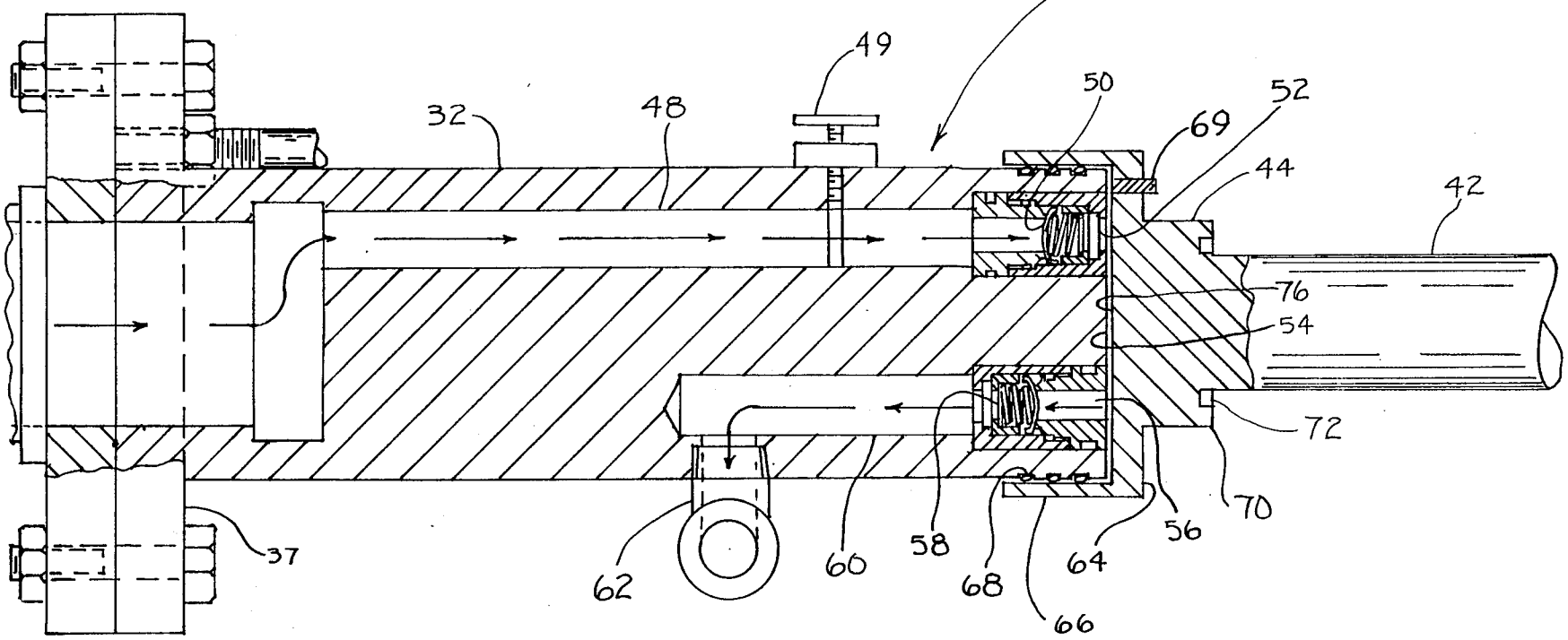
FIG. 3 is an enlarged view in section taken through the axis of the grease pump.
Figure 4:
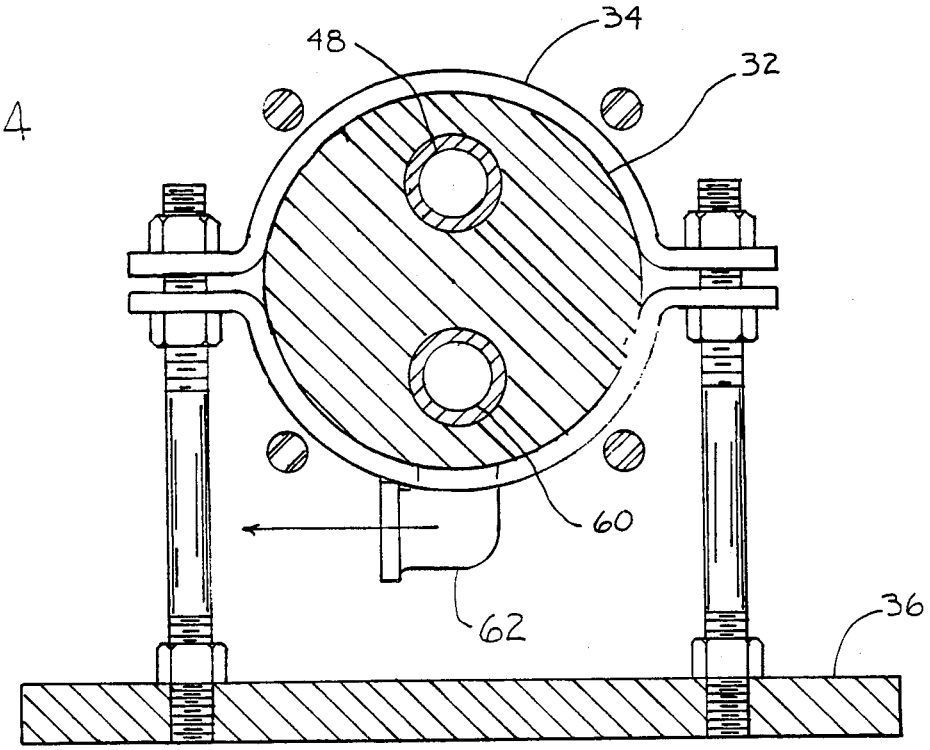
FIG. 4 is an enlarged view in section taken on the line 4—4 of FIG. 2.

The grease pump of this invention is generally indicated by the reference numeral 20 in FIGS. 1, 2 and 3. It is shown in FIGS. 1 and 2 as being connected to a grease hopper 22 as a source of grease and to a clamp 24 attached to a rail 26 of a railroad track. A grease line 28 delivers grease from the pump 20 to a lubricating device generally indicated by the reference numeral 30 in FIG. 7.

The pump is comprised of a solid cylindrical housing 32 which is anchored by a saddle clamp 34 to a firm base 36 which is anchored to the ground to provide stability to withstand the great magnitude of force created in the pumping operation and the rail vibration as the cars of the train pass over the railroad track. The base may be anchored in concrete as desired.

The pump 20 is provided with an operating means responsive to the cyclic up and down vertical movement of the rail as the wheels of the car pass over the rail. This operating means is generally designated by the reference numeral 38 and is comprised of a rigid beam 40 fixed by the clamp 24 to the rail at one end and slidably connected at an opposite end to an operating rod 42 as best shown in FIGS. 1 and 2. The operating rod as best shown in FIG. 3 is formed with a pressure member or pressure plate 44 which acts as a working head against the pump housing to effect the pumping action as will be more fully described below.

Figure 6:
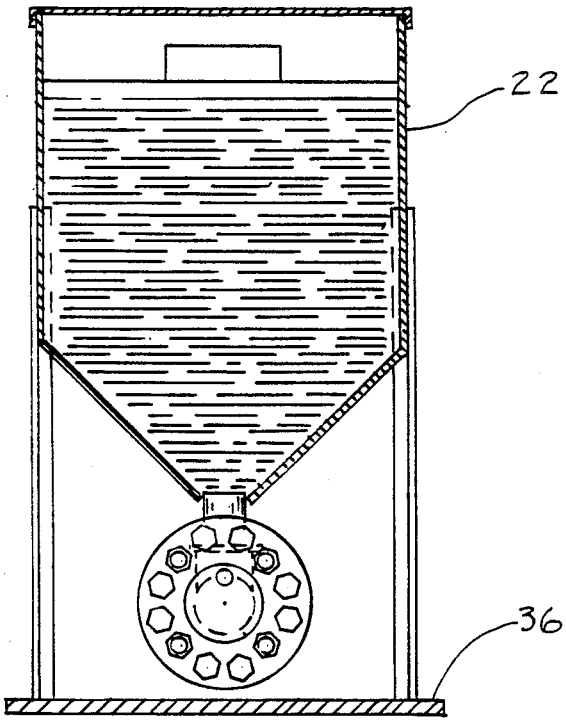
FIG. 6 is a view in section taken on line 6—6 of FIG. 2.

Describing the grease pump in more detail, it will be seen in FIGS. 2 and 6 that the grease hopper 22 is supported on the base 36 and has a funnel shaped hopper at the bottom communicating with a flanged elbow 46 connected to a flange 37 at the end of the pump housing. The elbow leads to a grease inlet line 48 at the top portion of the pump housing. A valve 49 may be employed to regulate the pumping flow. This line is provided with a check valve 50 which opens to permit flow of grease in the direction of the arrow in FIG. 3 when suction is encountered in the pump cycle but closes against back pressure. An inlet port 52 at the end of the inlet line opens into the end face 54 of the pump housing against the pressure member of operating rod.

The pump housing is further provided with an outlet port 56 at the end face which leads to a check valve 58 and outlet line 60. The two check valves 50 and 58 are conventional check valves which operate on a low pressure of 1 to 2 pounds per square inch such as those manufactured by Circle Seal Controls. An elbow nipple 62 connects the outlet line to the grease line 28 leading to the lubricating device 30 to deliver grease for the lubrication of the rail.

The inlet port 52 and outlet port 56 are located equidistantly from and on opposite sides of the axis of the cylindrical pump housing. They are situated on a diametrical line through the end face to provide efficient withdrawal of grease from the reservoir and expulsion through the pump in the automatic pumping operation as will be more fully understood hereinbelow.

The pressure member 44 is best shown in FIG. 3. It is constructed with a cup-shaped end portion 64 with a skirt 66 extending over the side wall of the pump housing 32 but spaced therefrom to permit a tilting movement as shown in FIGS: 9 and 10. Three O-rings or O-ring sealing members 68 are seated in grooves in the exterior of the pump housing and extend against the interior of the skirt to provide a seal for the relative movement between the pressure member and the pump housing. A removable bleed plug 69 is provided to evacuate any air bubbles or the like in the grease. This may also be in the form of a grease fitting or zerk for grease charging to the device. A shoulder 70 having a recess 72 provides a seat for a biasing spring 74 to urge the pressure member against the end face of the pump.

Grease is admitted between the end face and the interior of the biased pressure member to provide a reservoir. This reservoir acts as a pressure chamber between the inlet and outlet ports 52 and 56 through which grease passes responsive to the pumping action of the pressure member.

The biasing action of the spring 74 is effected by a compression plate 78 which is varied by adjustable compression rods connecting the pressure plate with the flanged end 37 of the pump housing as best shown in FIG. 2. By adjusting adjustment nuts 80 and 82 on opposite sides of the compression plate the plate can be moved toward the pump housing flange to increase the compression force on the biasing spring 74 or in the opposite direction to reduce the force of the biasing spring as desired.

Figure 5:
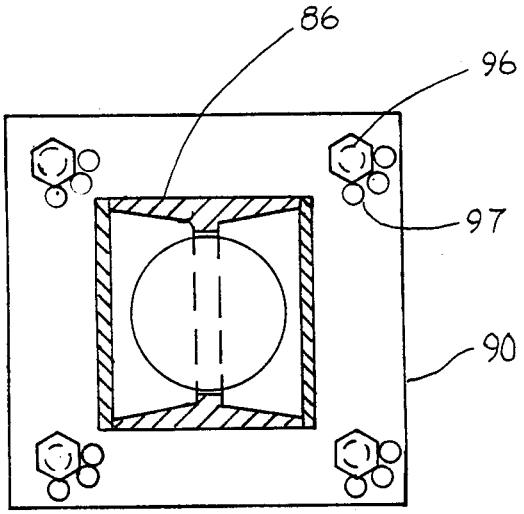
FIG. 5 is ane enlarged view in section taken on line 5—5 of FIG. 2.

The connection of the rigid beam 40 to the operating rod 42 is best shown in FIGS. 1, 2 and 5. The rigid beam is in the form of a steel I-beam which may be in two segments 84 and 86 joined by a flanged connection 88. The beam segment 84 has a bevelled downwardly slanting end surface 89 which acts to expel any roadbed fill in during the pumping action. The beam segment 86 has a flange 90 which receives a sleeve 92 having a flanged portion 94 which is connected to the aforementioned beam by bolts 96. A series of openings 97 are provided in the flange 90 in order that the two flanges 90 and 94 may be adjusted horizontally and vertically with respect to one another. By this means proper alignment may be maintained between the beam and the operating rod to accommodate any rail shift.

The sleeve 92 receives the end portion of the operating rod in axially slidable relation and may be provided with a grease port (not shown) to provide for lubrication. The provision for axial sliding movement of the operating rod accommodates any axial thrust of the beam as the rail is deflected and ensures that the force transmitted by the beam upon the operating rod is through a vertical plane. Also any rail shift through passage of time or created by any external force may be accommodated without appreciable effect upon the pump.

In order to receive the end of the operating rod the beam segment 86 is provided with an axially extending slot 98 which extends through the central web of the I-beam and the flange 90 as best shown in FIGS. 1 and 2. This slot accommodates any relative axial movement between the beam and the operating rod and permits the withdrawal of the operating rod and replacement of the O-rings. Cover plates or fish plates 100 are connected to the top and bottom of the I-beam on both sides of the slot to form a protective cover for the interior and also provide strength for the cut out beam portion. This cover may be extended for the entire length of the beam where desired for additional strength.

Figure 7:
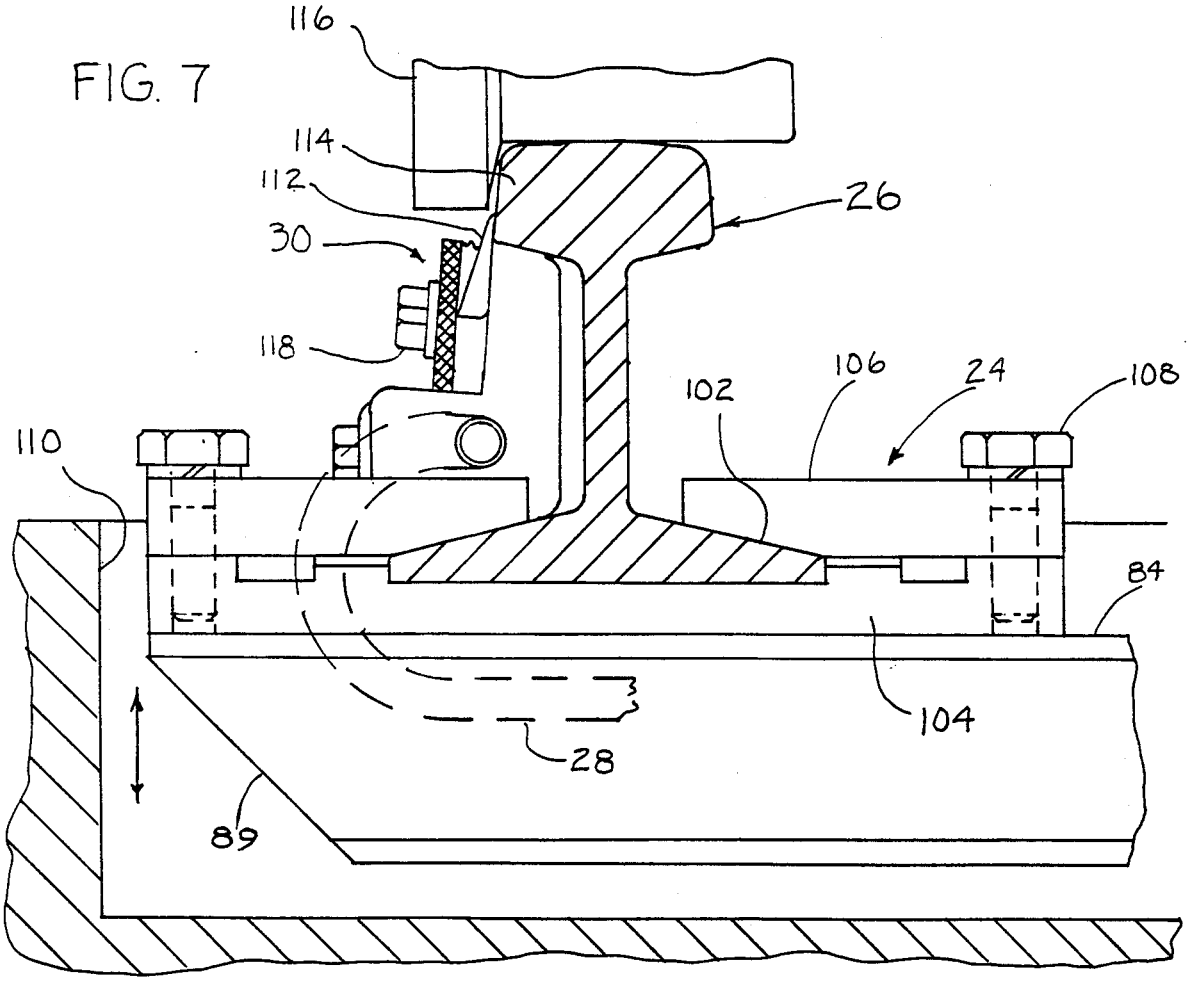
FIG. 7 is an enlarged fragmentary view of the left hand portion of FIG. 2 showing the connection of the grease pump to the railroad track.

The beam segment 84 is connected between adjoining railroad ties to the foot 102 of the rail 26 as shown in FIG. 7. The clamp has a base 104 fixed to the beam and which forms a seat for the foot of the rail. Retaining plates 106 fit over the foot of the rail and are bolted to the base of the clamp by bolts 108. The ground underneath the clamp and the beam is dug out to the near end of the pump housing to form a trench 110 in the road bed in order that any rail deflection may be freely transmitted through the operating means comprising the beam and operating rod to the pressure member to effect the pumping operation.

The lubricating device 30 is also shown in FIG. 7 and may take the form as shown or by any other conventional grease applicator for applying grease to the rail from the pump. The lubricating device is clamped to the rail and receives grease under pressure from the grease hose 28. The grease is delivered to a porous pad 112 applied to the rail seat 114 where it is picked up by the wheel 116 as it passes over the rail. The wheel picks up the grease and carries it as it progresses down the rail to transmit it to downstream portions of the curve to minimize wear on both the rail and the wheel. An adjustment bolt 118 may be used to connect the replaceable greese pad.

OPERATION

The grease pump system of this invention is relatively simply installed at the beginning of a tangential railroad curve or other track area requiring lubrication. Where used on a curve the system is applied to the outside rail against which the flanged wheel bears through the effect of centrifugal force.

The ground preparation required for the system is relatively simple in that only a trench under the track extending to the grease pump is required to provide an area in which the beam 40 and operating rod 42 may move up and down freely in the pumping operation. The base 36 to which the pump housing 32 is anchored by the saddle clamp and which supports the grease hopper may seat on a concrete foundation to provide the required stability.

At the start of operation the hopper is filled with a conventional grease used in railroad lubrication such as Texaco 904. The pump is charged with grease such as by exerting pressure on the grease in the hopper to force grease through the pump housing 32 and grease hose 28 to the lubricator device 30. In this charging operation the pressure member and operating rod may be manually reciprocated axially to cause a pumping action to effect the grease flow. The biasing spring compression plate may be first loosened in this operation and then tightened. The bleed plug may be withdrawn to evacuate any air in the system to prevent air lock. After the pump system and lubricator 30 have been appropriately charged the system is ready for automatic pumping operation responsive to railroad traffic passing over the rail 26.

The pumping operation is effected as the wheel 116 passes over the rail 26. As the wheel passes over the rail the rail will be depressed downwardly due to the great force concentrated at this point and the rail will cycle up and down as the train passes over the point of the clamped connection of the beam 40 to the rail. This up and down movement is transmitted to the left end of the operating rod 42 which in turn will cycle from the static rest situation in the up position as shown in FIG. 9 and above this position to the deflected down position in FIG. 10.

The operating rod is biased tightly toward the right as shown in FIG. 1 by the spring 74 to urge the pressure member 44 against the end face 54 of the pump housing. The slidable bearing reception of the operating rod within the sleeve 92 which is fixed to the beam segment 86 by the adjustable flanged connection accommodates this relationship vis-a-vis the axially fixed beam.

Figure 9:
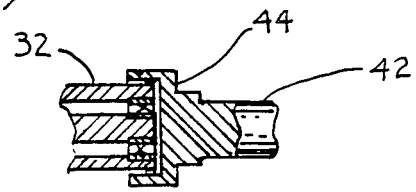
FIG. 9 is an exaggerated fragmentary view in horizontal section through the grease pump showing the pressure member and operating rod in a rest or static position.
Figure 10:
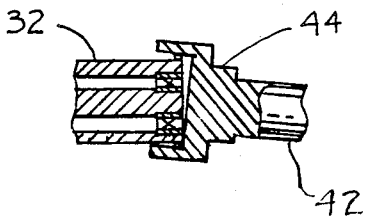
FIG. 10 is a view similar to FIG. 9 showing the pressure member and operating rod in the downwardly deflected position.

In the pumping action as the cup-shaped pressure member is caused to move to the down position shown in FIG. 10 the viscous grease is withdrawn through the low pressure check valve 50 in the inlet port to the reservoir 76 in the pressure member 44 and grease is forced through check valve 58 in the outlet port to the grease hose 28 and to the rail lubricating device 30. The withdrawal of grease through the inlet line may be thought of as being effected by suction or the surface tension exerted by the fluid grease between the opposing surfaces of the pump end face and the interior of the pressure member. In the return stroke to the static or rest position shown in FIG. 9 and above this position the one way check valves are closed and grease is prevented from being withdrawn from the hose 28 through check valve 58 or being pumped from the reservoir back through check valve 50 to the inlet line and grease in the reservoir between the pump housing end face at the interior of the pressure member is available for the next pumping operation. This explanation as to the nature of operation is made without applicant being bound by any theory presented.

In the pumping operation the pressure member can oscillate or rock back and forth as shown in FIGS. 9 and 10 and maintain a seal about the end of the pump housing due to the loose fit clearance between the skirt 66 and the outside of the pump housing 32 by virtue of the sealing action of the O-ring 68. Thus, oscillating or wobbling action is permitted by the O-rings and their resilient nature and also provide a seal.

In the afore-mentioned pumping action the pressure member 44 is maintained tightly against the grease in the reservoir and the end face of the pump by the biasing action of the compression spring 74. The force of this spring may be adjusted by varying the position of the compression plate 78 as desired.

Relative axial movement between the operating rod 42 and the beam which may be encountered in the pumping action is effectively accommodated by the sliding fit of operating rod within its bearing sleeve 92. As the beam segment 86 is provided with the access slot 98 the end of the rod may be moved back and forth freely with respect to the beam. Thus, any lateral shift of the rail does not affect the operating rod. Further, when replacement of the O-ring is desired the cover plates 100 may be removed and the operating rod retracted to allow new O-rings to be inserted as desired.

Any adjustment for alignment purposes between the beam and the operating rod and the pumping housing may also be simply effected. The series of alignment holes 97 permit horizontal and vertical shift in a vertical plane between the flanges 90 and 94 of the beam segment 86 and the sleeve 92 which supports the end of the operating rod.

The dispensing of the grease through the hose 28 to the grease applicator device 30 may be effected at the area of the clamp 24 for the beam or at a remote point as will be readily understood. The applicator device 30 is conventional and it will be appreciated that other such devices for applying the grease from the grease line 28 to the rail may be used as desired.

Through this invention the tremendous foce of the rail displacement and deflection has been harnessed to provide an oscillating type of pump action on a grease pump. The oscillating cup-shaped pressure member and check valve system provide an effective pumping operation without complex reciprocal plunger or piston type of pump action and a minimum of moving parts to service. The rugged and simple structure is particularly effective for the severe wear and tear subjected by railroad equipment which must withstand physical abuse and be left unattended in hard to reach outlying locations.

Various changes and modifications may be made within this invention as will be apparent to those skilled in the art. Such changes and modifications are within the scope and teaching of this invention as defined in the claims appended hereto.

What is claimed is:

1. A grease pump for railroad tracks adapted to be actuated by rail deflection caused by rail traffic, said pump comprising a source of grease, a stationary pump housing having a horizontally extending axis, said housing having an inlet port communicating with the grease source, an outlet port in said housing communicating with a grease lubricator means for applying grease to a portion of said railroad track and pump operating means connected to a rail of said track and said grease pump housing for forcing grease through said outlet port, said inlet and outlet ports being vertically spaced from one another, said pump housing comprising a grease reservoir bridging and extending between said inlet port and said outlet port and said operating means comprising a moveable pressure member forming a vertically extending front wall of said reservoir, said operating means further comprising a horizontally extending rigid operating means connecting said rail with said pressure member and being responsive to deflections in the rail to oscillate said pressure member back and forth across the axis of the housing and effect a pumping action on grease in said reservoir and force it through said outlet port.

2. The grease pump of claim 1 in which check valves are positioned on either side of the reservoir in the pump housing in the inlet port and the outlet port.

3. The grease pump of claim 1 in which biasing means are provided for urging said pressure member into engagement with said housing.

4. The grease pump of claim 1 in which anchoring means are provided for firmly anchoring said housing to the ground.

5. The grease pump of claim 1 in which anchoring means are provided for firmly anchoring said housing to the ground and said pressure member comprises a cap-like element fitting over an end portion of said housing forming said reservoir.

6. The grease pump of claim 1 in which the rigid operating means comprises adjustment means, said adjustment means connecting the rigid operating means to said pressure member in adjustable horizontal and vertical relation thereto.

7. The grease pump of claim 1 in which means are provided for anchoring the pump housing to the ground.

8. The grease pump of claim 1 in which said pressure member is oscillated back and forth responsive to the rail deflections and means are provided for biasing said pressure member toward an end face of the pump housing while it is oscillated.

9. The grease pump of claim 1 in which the rail is supported upon a road bed, said road bed having a trench underneath means connecting the operating means to the rail and extending underneath the operating means to the pump housing to provide an unobstructed area for movement of the operating means responsive to the rail deflections.

10. The grease pump of claim 1 in which the operating means comprises a rigid beam having means fixedly connecting it at one end to said rail and said rail is supported upon a road bed, said road bed having a trench underneath the means fixedly connecting the beam and extending underneath the operating means to the pump housing to provide an unobstructed area for movement of the operating means responsive to the rail deflections, an end of said beam being positioned underneath said rail and having a downwardly slanting end surface to counteract any tendency of said road bed to fill in under the rail.

11. The grease pump of claim 1 in which said operating means include a rigid beam fixed at one end to said railroad track and slide means connecting an opposite end to an operating rod connected to the pressure member in axially slidable relation therebetween, said beam member and operating rod being vertically moveable together responsive to vertical rail deflections.

12. The grease pump of claim 11 in which the operating means comprises a sleeve closely receiving said operating rod in axially slidable relation and said sleeve is fixed to said rigid beam.

13. The grease pump of claim 12 in which the operating means comprises adjustment means for readily adjusting the sleeve with respect to said rigid beam in a horizontal and vertical direction.

14. The grease pump of claim 12 in which said beam has an end provided with a slot receiving an end of said operating rod and protective cover means are provided for said slot.

15. The grease pump of claim 1 in which said pressure member comprises a cap-like element fitting over an end portion of said housing forming said reservoir, said end portion being in open communication with both said inlet and outlet ports.

16. The grease pump of claim 15 in which biasing means are provided for urging said pressure member into engagement with said housing.

17. The grease pump of claim 15 in which the cap-like element has an interior faced portion adapted to be biased toward a congruent end face of the end portion of the pump housing communicating with said inlet and outlet ports and forming with the end face of the pump housing said grease pump reservoir.

18. The grease pump of claim 15 in which a bleeder means is provided in said cap-like element for evacuating any air in the grease as it is pumped through the reservoir.

19. The grease pump of claim 15 in which said housing end portion is in a vertical plane having the inlet and outlet ports opening into a vertical face of said end portion and said cap-like element has a vertical face mating with the vertical face of said pump housing end portion.

20. The grease pump of claim 15 in which said cap-like element has a skirt-like portion fitting over said end portion of said housing in sealed relation thereto.

21. The grease pump of claim 20 in which O-ring sealing members are interfitted between an exterior portion of the housing and the skirt-like portion of said cap-like element to provide a seal therebetween and permit said back and forth movement.

22. The grease pump of claim 15 in which biasing means are provided for biasing said cap-like element against the end portion of said housing.

23. The grease pump of claim 22 in which adjustment means are provided for adjusting the biasing force of said biasing means.

24. The grease pump of claim 15 in which said rigid operating means comprises adjustment means, said adjustment means connecting the rigid operating means to said cap-like element in adjustable horizontal and vertical relation thereto.

25. The grease pump of claim 24 in which said adjustment means comprises a flange-like member connected to a rigid beam having means fixedly connecting it at one end to said railroad track and having a series of openings receiving fastening means for fastening an opposite end of said rigid beam to the flange-like member.

* * * * *